US005501074A

United States Patent [19]

Suetsugu et al.

[11] Patent Number: 5,501,074

[45] Date of Patent: Mar. 26, 1996

[54] EXHAUST GAS PURIFYING SYSTEM

[75] Inventors: Hajime Suetsugu, Higashihiroshima; Tadataka Nakazumi, Kure; Akihide Takami, Hiroshima; Takashi Takemoto, Higashihiroshima, all of Japan

[73] Assignee: Mazda Motor Corporation, Hiroshima, Japan

[21] Appl. No.: 215,769

[22] Filed: Mar. 22, 1994

[30] Foreign Application Priority Data

Mar. 31, 1993 [JP] Japan ..... 5-096587

[51] Int. Cl.[6] ..... F01N 3/28

[52] U.S. Cl. ..... 60/285; 60/301

[58] Field of Search ..... 60/285, 301, 276

[56] References Cited

U.S. PATENT DOCUMENTS

| | | | |
|---|---|---|---|
| 4,729,220 | 3/1988 | Terasaka | 60/276 |
| 5,209,061 | 5/1993 | Takeshima | 60/285 |
| 5,211,010 | 5/1993 | Hirota | 60/285 |
| 5,211,011 | 5/1993 | Nishikawa | 60/285 |
| 5,343,702 | 9/1994 | Miyajima | 60/301 |

FOREIGN PATENT DOCUMENTS

| | | |
|---|---|---|
| 53-122008 | 10/1978 | Japan . |
| 56-17533 | 4/1981 | Japan . |

*Primary Examiner*—Douglas Hart
*Attorney, Agent, or Firm*—Keck, Mahin & Cate

[57] ABSTRACT

An exhaust gas purifying system for an automobile engine is equipped with a metal zeolite catalytic converter for deoxidizing and purifying nitrogen oxides in exhaust gas. The system controls and compulsorily changes the air-fuel ratio of the fuel mixture injected into the automobile engine based on a target air-fuel ratio only when the temperature of the exhaust gas, before entering the catalyst, is greater than a specific temperature.

7 Claims, 4 Drawing Sheets

EXHAUST GAS PURIFYING SYSTEM

BACKGROUND OF THE INVENTION

1. Field of the Invention

The present invention relates to an exhaust gas purifying system for an internal combustion engine.

2. Description of Related Art

Typically, engine exhaust gas purifying systems for engines, which are equipped with a three-way catalytic converter disposed in an exhaust system, perform what is called in the specification a "perturbation control," referring to control in which periodic changes in air-fuel ratio of a fuel mixture supplied to the combustion chamber of an engine are compulsorily made based on a target air-fuel ratio. Such an engine exhaust gas purifying system is known from, for instance, Japanese Unexamined Patent Publication No. 53-122008 or No. 56-17533. With this engine exhaust gas purifying system, although a decline in the stability of engine operation, which results in, for instance, torque fluctuations and the deterioration of driving performance, is caused to a certain degree by fluctuations of the air-fuel ratio, from the aspect of exhaust gas purification, the so-called perturbation control causes an efficient reaction between unburned components of fuel absorbed in excess by the catalyst when the air-fuel ratio is on a rich side and oxygen absorbed in excess by the catalyst when the air-fuel ratio is on a lean side, resulting in an improvement in purifying performance.

However, with the advent of lean burning engines in recent years, catalysts have been developed to make deoxidation or reduction and purification of nitrogen oxides possible even in exhaust gases produced under high temperature conditions of oxygen ($O_2$) during lean-burning. If the perturbation control is performed, it is thought that such a catalyst for deoxidizing or reducing and purifying nitrogen oxides in exhaust gases (which is hereafter referred to a nitrogen oxide catalyst) decreases the apparent amount of oxygen ($O_2$) near the surface of the nitrogen oxide catalyst, keeping the deoxidation or reduction of nitrogen oxides from being hindered due to a high temperature of oxygen ($O_2$) in the exhaust gas. Accordingly, the perturbation control is expected to be effective even with respect to nitrogen oxide catalysts from the aspect of improvement in purifying performance.

It was found by the inventor of this invention that although, as expected, the nitrogen oxide catalyst can be enhanced in nitrogen oxide purifying performance by the perturbation control when the temperature of the exhaust gas is above a specific level at the entrance of the nitrogen oxide catalyst, it purifies nitrogen oxides with the same efficiency when the perturbation control is conducted as when not conducted, while the temperature of the exhaust gas is below the specific level. Consequently, if the perturbation control is conducted with no consideration for the temperature of exhaust gas at the entrance of the nitrogen oxide catalyst, neither the stability of engine nor the improvement of purifying performance of the nitrogen oxide catalyst can be realized within a certain range of exhaust gas temperatures, thereby nullifying the significance of the perturbation control.

SUMMARY OF THE INVENTION

It is an object of the present invention to provide an exhaust gas purifying system for an automobile engine which can improve the stability of engine operation while enhancing the purification efficiency of a catalyst through perturbation control.

This object of the present invention is accomplished by providing an exhaust gas purifying system equipped with a catalytic converter suitable for deoxidizing and purifying nitrogen oxides in exhaust gas discharged from an engine, such as a lean burn engine. In this control system, a so-called perturbation control, which is compulsorily conducted in order to periodically change an air-fuel ratio of a fuel mixture based on a target air-fuel ratio determined based on engine operating conditions is effective only when the temperature of exhaust gas is greater than a specific level of temperature.

Specifically, the exhaust gas purifying system sets the specific level of temperature to a temperature at which the catalytic converter, which is of the type including precious metal zeolite, exhibits the highest exhaust gas purifying rate under the target air-fuel rate. The specific level of temperature may be lower with a change in the target air-fuel ratio toward a lean side.

Because the compulsory conduction of the perturbation control of air-fuel ratio is conducted only when the temperature of exhaust gas before the nitrogen oxide catalyst is above a specific level of temperature, the perturbation control takes place only within the region where it is effective and it is not conducted in the region in which it is not expected to be effective. Consequently, in the region in which perturbation does not take place, it is possible to prevent fluctuations in engine output torque. Hence, an improvement in the stability of engine operation is realized while the purification of the nitrogen oxide catalyst is enhanced by the perturbation control.

Furthermore, in the case where a precious metal zeolite catalyst is used, the specific level of temperature is changed in response to the characteristic of the metal zeolite catalyst which has a decline in the temperature of exhaust gas suitable for the maximum rate of purification as the air-fuel ratio becomes leaner. Therefore, desired effects can always be realized, regardless of changes in target air-fuel ratio.

BRIEF DESCRIPTION OF THE DRAWINGS

The above and other objects and features of the present invention will be clearly understood from the following description with respect to a preferred embodiment thereof when considered in conjunction with the accompanying drawings, in which.

DETAILED DESCRIPTION OF THE PREFERRED EMBODIMENT

Figure 1:
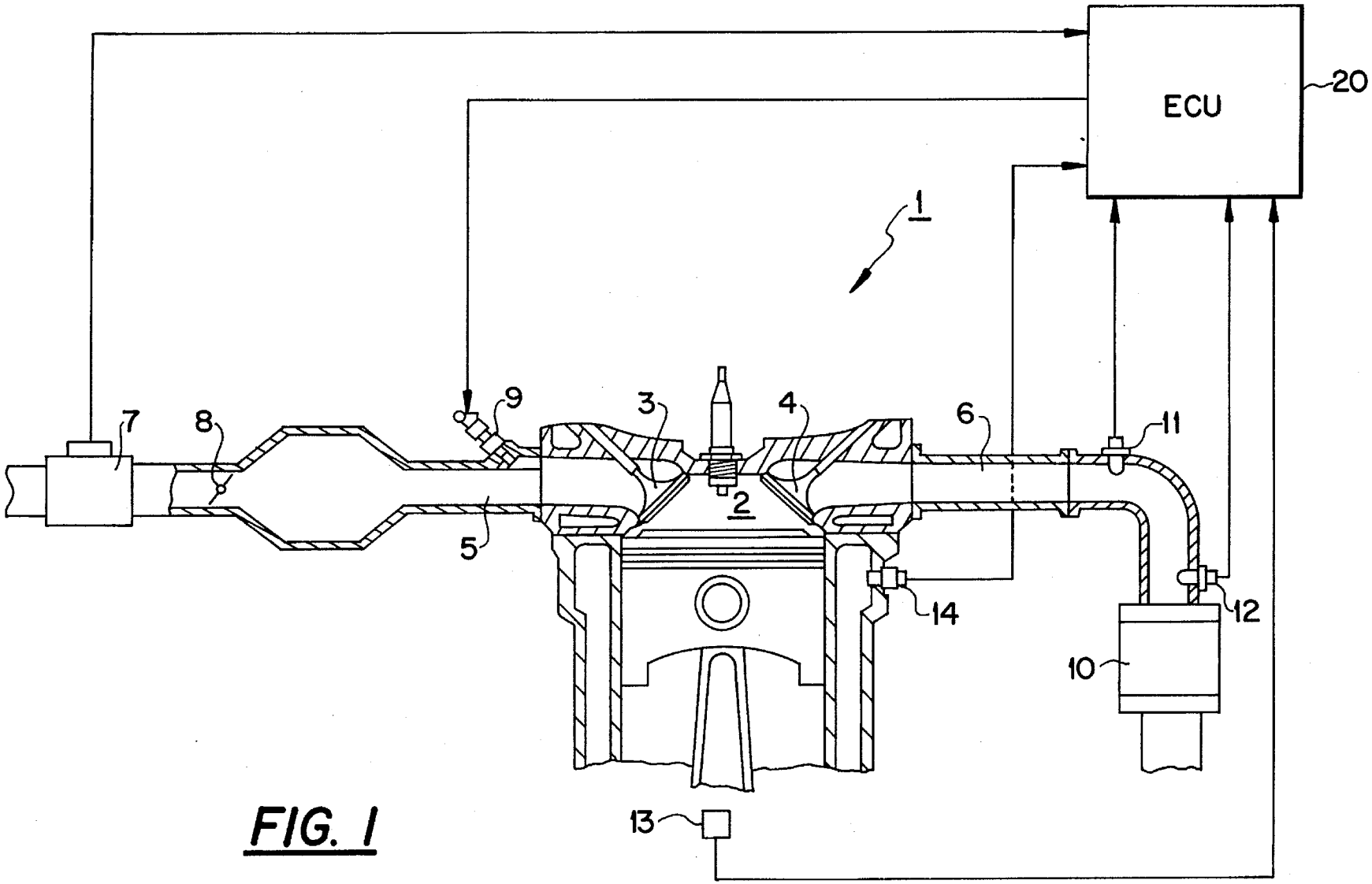
FIG. 1 is a schematic view of an internal combustion engine equipped with an exhaust gas purifying system in accordance with a preferred embodiment of the present invention.

Referring to the drawings in detail, and, in particular, to FIG. 1, a lean burn engine 1, such as an Otto type four-cycle reciprocating internal combustion engine of an automobile, equipped with an exhaust gas purifying system in accordance with a preferred embodiment of the present invention, is schematically shown. The engine 1 is provided with an intake line 5 in communication with a combustion chamber 2 through an intake valve 3, and an exhaust line 6 in communication with the combustion chamber 2 through an exhaust valve 4. The intake line 5 is provided in order from the upstream end thereof with an air flow sensor 7, a throttle valve 8, and a fuel injection valve 9. The exhaust line 6 is provided with a catalytic converter 10 which has been designed and adapted to deoxidize or reduce and purify nitrogen oxides in exhaust gases (which is hereafter referred to a nitrogen oxide catalyst) for which, for instance, utilization is made of a precious metal zeolite catalyst composed of zeolite with precious metals such as platinum, iridium or the like, supported thereon. This nitrogen oxide catalytic converter 10 is capable of removing nitrogen oxides along with hydrocarbons and carbon monoxide even during periods of high oxygen concentrations in the exhaust gas caused by the engine running with an air-fuel ratio on a lean side.

An electronic control unit (ECU) 20, which is comprised of a microcomputer, receives various signals from sensors 11–14, as well as a signal from the air flow sensor 7. An oxygen ($O_2$) sensor 11 detects the concentration of residual oxygen ($O_2$) in exhaust gas before the exhaust gas enters the nitrogen oxide catalyst 10. A temperature sensor 12 detects the temperature of exhaust gas at or just before the entrance of the nitrogen oxide catalytic converter 10. A speed sensor 13 detects the rotational speed of engine. A temperature sensor 14 detects the temperature of engine cooling water. The control unit 20 provides a signal to the fuel injection valve 9.

Figure 2:
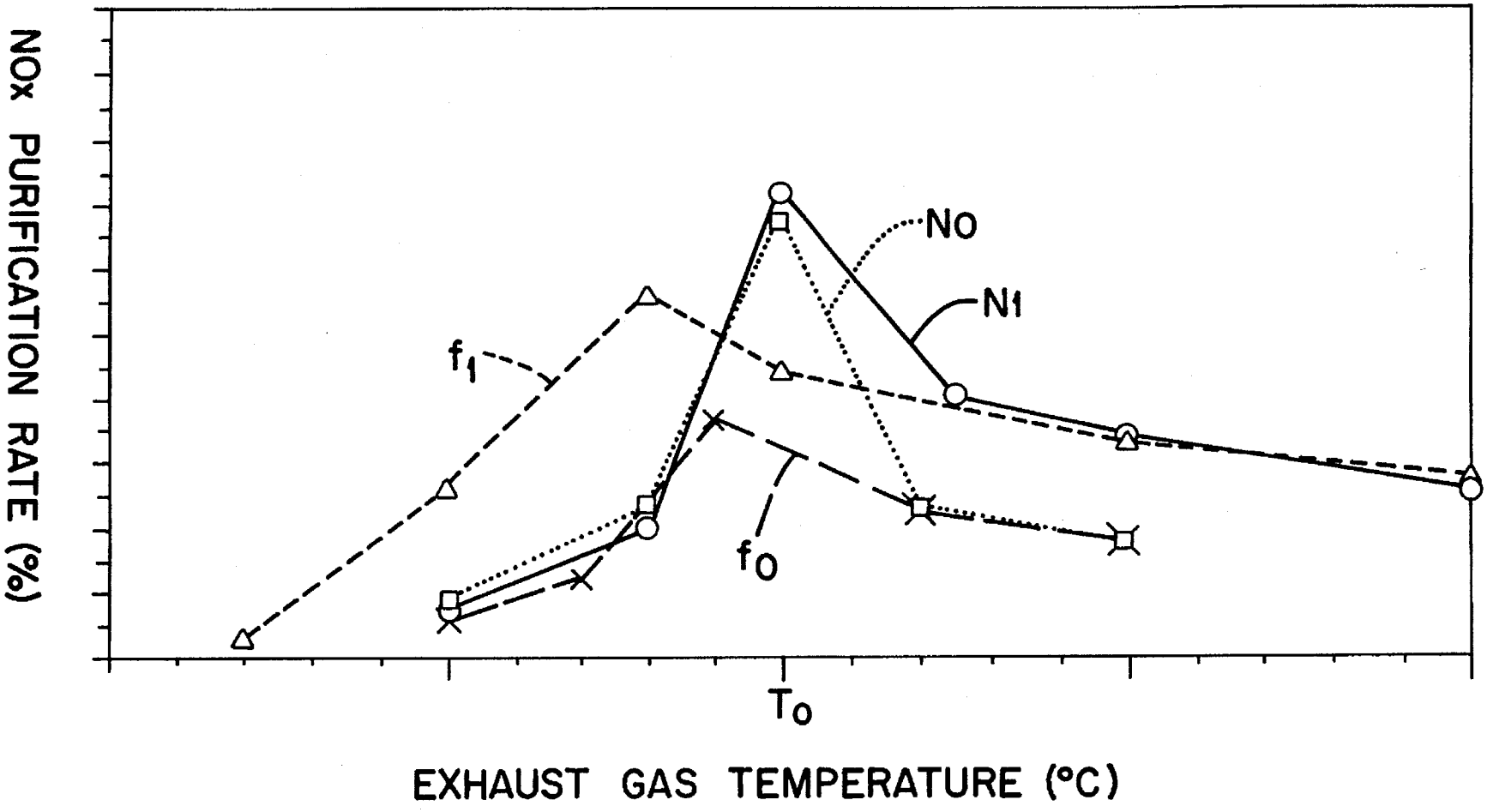
FIG. 2 is a characteristic diagram showing nitrogen oxide purification rates of three-way catalysts relative to exhaust gas temperature with respect to different conditions.

Referring to FIG. 2 showing the characteristics of a nitrogen oxide catalyst as determined by the inventors of this invention, in a three-way catalytic converter or catalytic converter rhodium (CCRO), in contrast to the case indicated by line fo where exhaust gas flows under a constant air-fuel ratio, in the case indicated by line $f_1$ where the air-fuel ratio of a fuel mixture is controlled to change periodically based on a target air-fuel ratio (which control is hereafter referred to as a perturbation control), the purification rate was enhanced regardless of the temperature of exhaust gas at the entrance of a catalytic converter. On the other hand, with the nitrogen oxide catalyst 10, when the temperature of exhaust gas is higher than a specific level, i.e. the temperature of exhaust gas To that yields the maximum purifying rate of nitrogen oxide under the target air-fuel ratio, the execution of perturbation control showed a higher nitrogen oxide purification rate, as indicated by line N1, than when the perturbation control was not executed as indicated by No. Conversely, when the temperature of exhaust gas is lower than the specific level To, the purifying rate of nitrogen oxide was essentially the same regardless of the execution of perturbation control. These results tend to indicate that though the decomposition reaction of nitrogen oxide depends upon the flow rate of exhaust gas or residence time (the time for which gas stays in the catalyst), the temperature of gas, and the concentrations of nitrogen oxides (NOx), hydrocarbons (HC), and oxygen ($O_2$), however, when the temperature of exhaust gas is greater than the specific temperature To correlated with the maximum temperature of catalytic activity, the concentration of oxygen becomes a main ruling factor and, when the concentration of oxygen ($O_2$) is high, it is hard for the deoxidation or reduction reaction of nitrogen oxide (NOx) to occur.

However, if the perturbation control is accomplished, the apparent amount of oxygen ($O_2$) near the catalyst surface declines, thereby realizing an increase in catalytic activity. Therefore, it is considered that if the perturbation control is conducted at temperatures of exhaust gas greater than the specific temperature To, namely the maximum temperature of catalytic activity, there is an enhancement of the purifying rate of nitrogen oxide (NOx). Conversely, it is considered that at temperatures of exhaust gas less than the specific temperature To, i.e. the maximum temperature of catalytic activity, the degree to which the deoxidation or reduction reaction depends upon the flow rate of gas and the temperature of exhaust gas becomes larger than the dependency on the concentration of oxygen ($O_2$). Therefore, even if the perturbation control is accomplished, it is hard to achieve the effects given by the perturbation control when it is conducted at temperatures of exhaust gas above the specific temperature To, so the purification rate of nitrogen oxide (NOx) is not changed by the perturbation control.

From the above empirical observation, with the exhaust gas purifying system according to the present invention, the perturbation control is accomplished only in the region in which the purifying performance of nitrogen oxides (NOx) can be enhanced, and is not accomplished in the region in which the purifying performance of nitrogen oxides (NOx) can not be enhanced, thus preventing torque fluctuations.

Specifically, from detecting whether or not the temperature of exhaust gas is in the region in which the purification performance of nitrogen oxide (NOx) can be enhanced by the perturbation control and comparing with reference to the specific temperature To constituting the maximum temperature of catalytic activity, (i.e. the judging standard of a ruling factor for the decomposition reaction of nitrogen oxide), the exhaust gas purifying system according to the present invention is constructed such that the perturbation control is accomplished when the temperature of exhaust gas at the entrance of the catalytic converter 10 is greater than the specific temperature To, and is prohibited when it is less than the specific temperature To.

Figure 3:
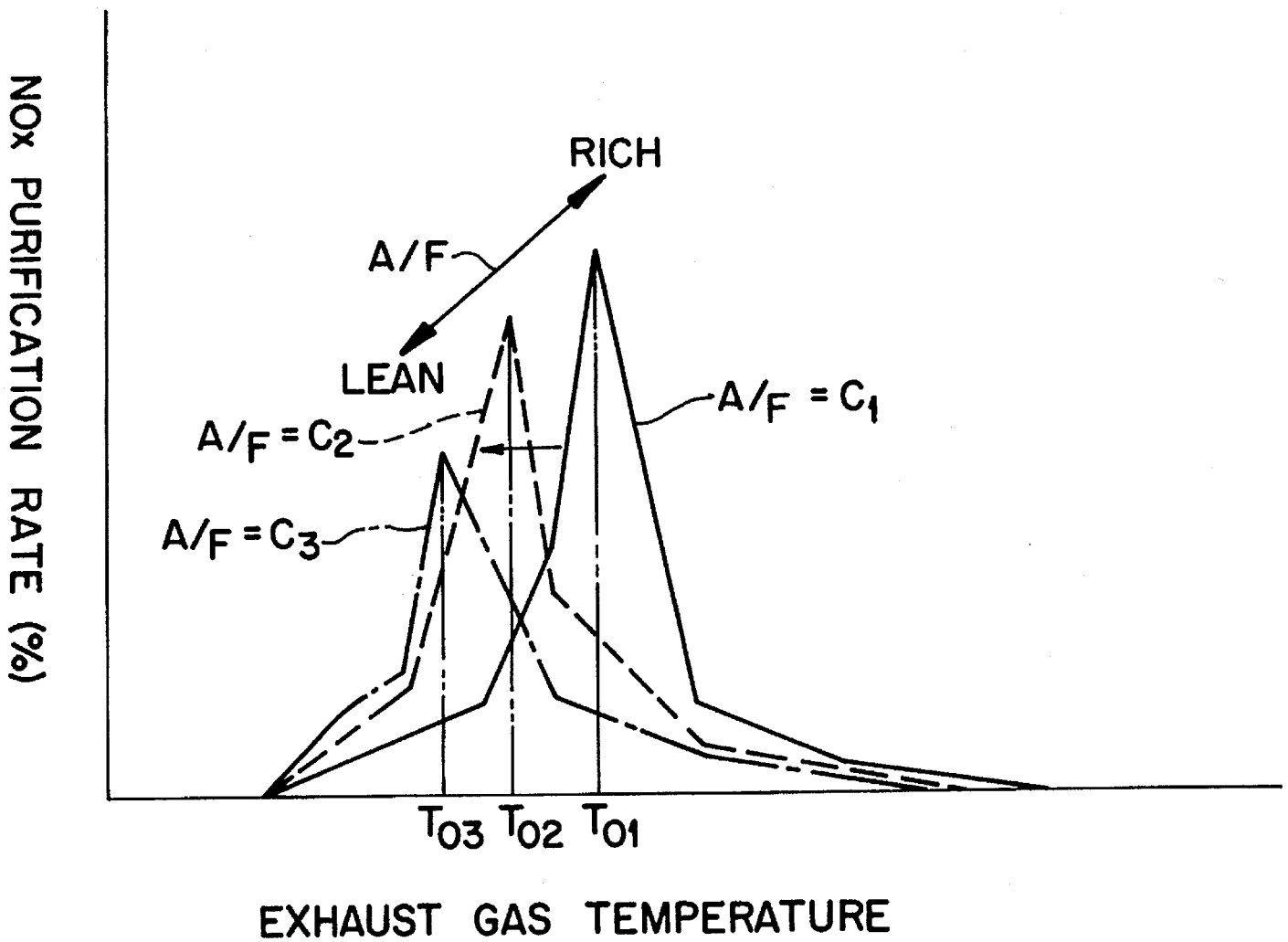
FIG. 3 is a characteristic diagram showing nitrogen oxide purification rates of a precious metal zeolite catalyst relative to exhaust gas temperature with respect to different conditions.

As shown in FIG. 3, the characteristics of nitrogen oxide catalysts, in particular precious metal zeolite catalysts, exhibit that the temperature of exhaust gas corresponding to the maximum purifying rate of nitrogen oxide (NOx), i.e. the maximum temperature of catalytic activity, decreases as the target air-fuel ratio becomes leaner. From this observation, the exhaust gas purifying system in accordance with the present invention is structured so as to shift the specific temperature To the lower side of temperatures as the target air-fuel ratio becomes leaner with a precious metal nitrogen oxide catalyst installed in the exhaust line 6.

The perturbation control, which is commonly known to those skilled in the art, generally modulates an air-fuel ratio feedback control signal by the use of a high frequency signal having an average value of zero (0) and generates fluctuations in the amount of fuel injected by the fuel injection valve 9 in accordance with the high frequency signal, thereby causing periodic fluctuations in air-fuel ratio of a fuel mixture supplied to the combustion chamber 2 of the engine 1 with reference to the target air-fuel ratio as a standard.

Figure 4:
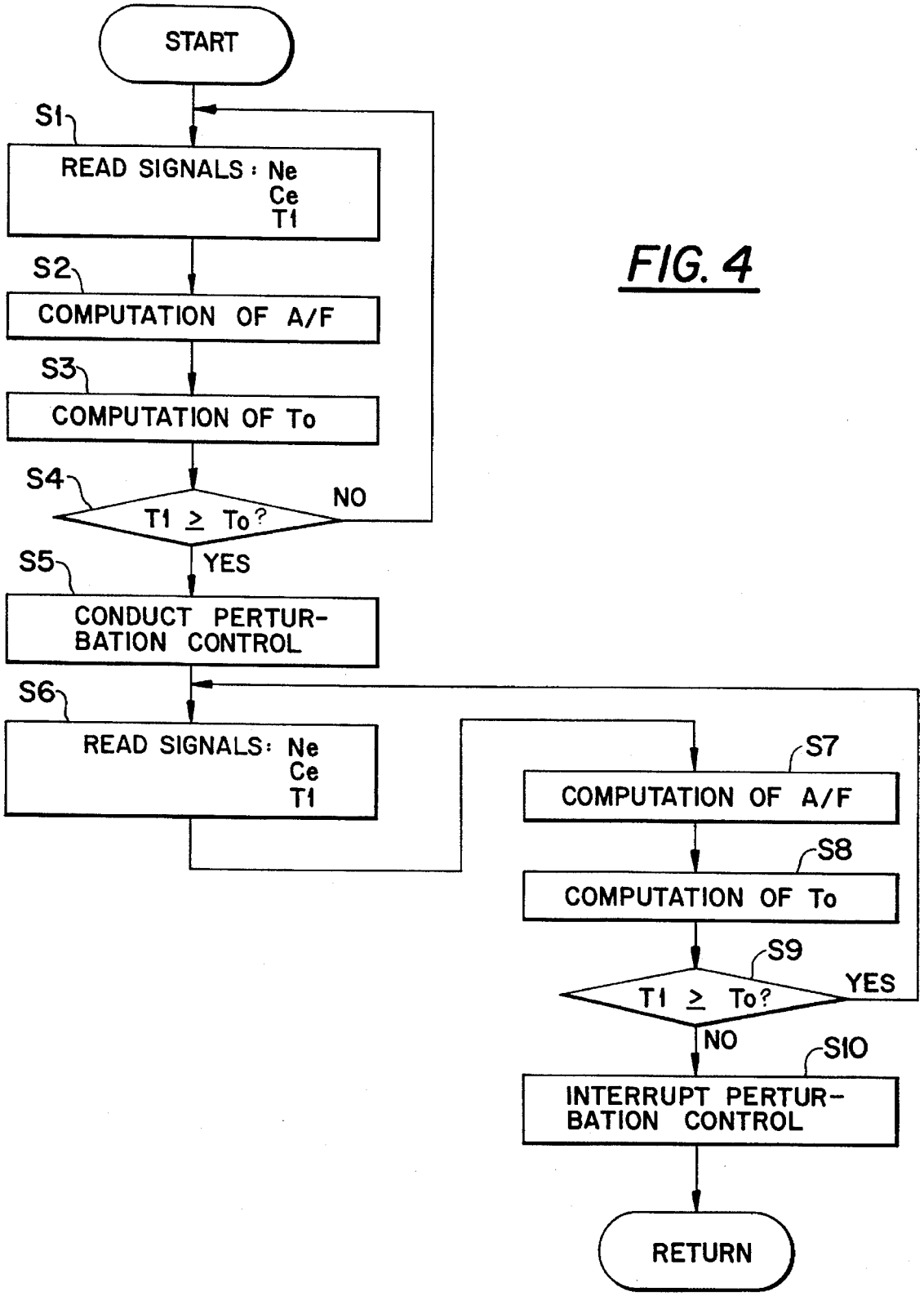
FIG. 4 is a flow chart illustrating the exhaust gas control sequential routine.

The operation of the exhaust gas purifying system depicted in FIG. 1 will be best understood by reviewing FIG. 4, which is a flow chart illustrating a routine for the microcomputer of the control unit (ECU) 20. Programming a computer is a skill well understood in the art. The following description is written to enable a programmer having ordinary skill in the art to prepare an appropriate program for the microcomputer. The particular details of any such program would of course depend upon the architecture of the particular computer selected.

Referring to FIG. 4, the first step S1 is to read various signals, such as a signal representative of the current rotational speed of engine Ne from the speed sensor 11, a signal representative of the amount of intake air (Ce) from the air flow sensor 7, and a signal representative of the temperature of exhaust gas T1 at the entrance of the catalytic converter 10 from the temperature sensor 12, which is substantially the same as the actual temperature of the catalyst. Subsequently, at step $2, a target air-fuel ratio A/F is computed from the rotational speed Ne of the engine 1 and the amount Ce of intake air introduced into the intake line 5. Further, at step S3, a specific temperature To, i.e. the maximum temperature of catalytic activity, is computed as the temperature of exhaust gas at the entrance of the catalytic converter 10 at which the maximum purifying rate of nitrogen oxide (NOx) is developed under the target air-fuel ratio A/F, based on the target air-fuel ratio A/F. In the case where the exhaust line 6 includes a precious metal-based nitrogen oxide catalyst, the computation of target air-fuel ratio A/F at step S2 has the significance of making the specific level of temperature To correspond to a decrease in the temperature of exhaust gas at which the maximum purifying rate of nitrogen oxide (NOx) is obtained under this target air-fuel ratio A/F, as the target air-fuel ratio A/F becomes leaner, as indicated in FIG. 3. In addition, the computation of a specific temperature To at step S3 also has the significance of the standard determination whether or not the perturbation control has to be conducted, in consideration of changes in ruling factor for the decomposition reaction of nitrogen oxide (NOx) based on the maximum temperature of catalytic activity.

Subsequent to the computation of the specific temperature To, a decision is made at step S4 as to whether or not the temperature of the exhaust gas T1 is greater than the specific temperature To. This decision is made in order to determine whether or not improvement in nitrogen oxide purifying performance is provided by the perturbation control When the answer to the decision is "NO" this indicates that there would be no effect from the perturbation control, then, the sequential control returns. On the other hand, when the answer to the decision is "YES, then, the perturbation control is conducted at step S5. Through this decision, no perturbation control is conducted when the temperature of the exhaust gas T1 is less than the specific temperature To, and therefore engine torque fluctuations are prevented, thereby enhancing the stability of engine operation. However, if the temperature of the exhaust gas T1 is greater than the specific temperature To, the purification of nitrogen oxide (NOx) is enhanced through the perturbation control.

In order to determine whether or not to continue the perturbation control, the same processes are executed at steps S6 through step S9. The perturbation control is continued as long as the "YES" answer to the decision made at step S9 concerning the temperature of the exhaust gas T1 is provided. On the other hand, when the "NO" answer is provided at step S9, this indicates that the perturbation control would have no effect even if it were conducted, and the perturbation control is interrupted at step S10.

It is to be understood that although the present invention has been described in detail with respect to a preferred embodiment, various other embodiments and variants may occur to those skilled in the art, which hall within the scope and spirit of the present invention. Such other embodiments and variants are intended to be covered by the following claims.

What is claimed is:

1. An exhaust gas purifying system having a catalytic converter, which is disposed in an exhaust line so as to deoxidize or reduce and purify nitrogen oxides in exhaust gases, for an automobile engine, said exhaust gas purifying system comprising:

an air-fuel ratio sensor for detecting an air-fuel ratio of a fuel mixture based on an oxygen concentration in exhaust gas discharged from said automobile engine;

a temperature sensor disposed upstream from said catalytic converter in said exhaust line for detecting temperature of exhaust gas; and control means for computing a target air-fuel ratio of a fuel mixture to be introduced into said automobile engine based on engine operating conditions, and compulsorily perturbing the air-fuel ratio of said fuel mixture based on said target air-fuel ratio only when said temperature sensor detects exhaust gas temperature greater than a specific temperature.

2. An exhaust gas purifying system as defined in claim 1, wherein said catalytic converter includes a precious metal zeolite catalyst.

3. An exhaust gas purifying system as defined in claim 2, wherein said precious metal zeolite catalyst is composed of zeolite with at least platinum and iridium contained thereon.

4. An exhaust gas purifying system as defined in claim 2, wherein said control means sets said specific temperature to that temperature at which said catalytic converter exhibits the highest exhaust gas purifying rate under said target air-fuel ratio.

5. An exhaust gas purifying system as defined in claim 2, wherein said control means further controls said specific temperature to a lower value when detecting a change in said target air-fuel ratio toward a lean side.

6. An exhaust gas purifying system as defined in claim 2, wherein said control means computes said target air-fuel ratio based on rotational speed of said automobile engine and a quantity of intake air introduced into said automobile engine.

7. An exhaust gas purifying system as defined in claim 1, wherein said temperature sensor is disposed upstream from said catalytic converter in said exhaust line.

* * * * *